US006382863B1

(12) United States Patent
To et al.

(10) Patent No.: US 6,382,863 B1
(45) **Date of Patent: *May 7, 2002**

(54) RING BINDER WITH COMPACT DISK HOLDER

(75) Inventors: Chun On To, Kowloon (HK); Keung Chan, An Hui (CN)

(73) Assignee: Laco Stationery Manufacturing Company, Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 09/899,504

(22) Filed: Jul. 5, 2001

Related U.S. Application Data

(63) Continuation-in-part of application No. 09/620,131, filed on Jul. 20, 2000, now Pat. No. 6,287,038.

(51) Int. Cl.[7] ..... B42F 13/00

(52) U.S. Cl. ..... 402/73; 402/4; 402/70; 281/37

(58) Field of Search ..... 402/73, 70, 80 P, 402/4; 206/308.3, 308.5; 281/37, 31

(56) References Cited

U.S. PATENT DOCUMENTS

| | | | | |
|---|---|---|---|---|
| 1,585,846 | A | 5/1926 | Frisbie | |
| 4,518,275 | A | 5/1985 | Rauch, III et al. | |
| 5,494,156 | A | 2/1996 | Nies | |
| 5,501,540 | A | 3/1996 | Ho | |
| 5,593,030 | A | 1/1997 | Tell | |
| 5,685,427 | A | 11/1997 | Kuitems et al. | |
| 5,913,420 | A | 6/1999 | Morita | |
| 6,179,120 | B1 | 1/2001 | Chou | |
| 6,287,038 | B1 * | 9/2001 | Chan | 402/73 |

OTHER PUBLICATIONS

Five (5) photographs of ring binder with transparent CD–holder in front cover; undated but admitted prior art; manufactured by Achilles Prasentationsprodukte GmbH, Germany.

* cited by examiner

*Primary Examiner*—Willmon Fridie, Jr.
(74) *Attorney, Agent, or Firm*—Senniger, Powers, Leavitt & Roedel

(57) ABSTRACT

A ring binder-type notebook for holding both loose leaf pages and at least one compact disk. The notebook includes a cover and a ring binder mechanism having a plurality of ring members for holding the loose leaf pages. A compact disk holder releasably holds the compact disk. The holder may be secured to the cover or secured to a loose leaf page. A metallic fastener having at least one securing member secures the holder, or alternatively an adhesive secures the holder. The holder has a mounting portion configured for releasably attaching engagement with the compact disk. The mounting portion is made of a plastic material.

11 Claims, 20 Drawing Sheets

RING BINDER WITH COMPACT DISK HOLDER

CROSS-REFERENCE TO RELATED APPLICATION

This application is a continuation-in-part of application Ser. No. 09/620,131, filed Jul. 20, 2000, now U.S. Pat. No. 6,287,038, which is herein incorporated by reference.

BACKGROUND OF THE INVENTION

This invention relates to ring binder-type notebooks, and in particular to a ring binder which holds both loose leaf pages and one or more compact disk. While it has been well known to record information and data on paper, today much information is stored on compact disks, whether such be audio compact disks, video compact disks or digital video disks. Although a large variety of ring binders are available for retaining loose leaf sheets of paper, these binders do not facilitate storage of a compact disk. As a result, a person using a compact disk must store the disk separately from loose leaf sheets of paper which are retained by a ring binder. That is inconvenient, especially when the compact disk contains information relevant to other information recorded on the loose leaf pages.

SUMMARY OF THE INVENTION

Among the several objects and features of the present invention may be noted the provision of a ring binder for simultaneously retaining both loose leaf pages and on one or more compact disk; the provision of such a binder which inhibits damage to a compact disk; the provision of such a binder which securely holds a compact disk regardless of minor dimensional variations; and the provision of such a binder which may be readily prepared from existing binders.

Generally, a ring binder according to the present invention simultaneously holds loose leaf pages and at least one compact disk having a center hole therethrough. The notebook comprises a cover including two side panels and a ring binder mechanism secured to the cover, the mechanism including a plurality of ring members for holding the loose leaf pages. A compact disk holder is secured to the cover for releasably holding the at least one compact disk. The holder has a mounting portion configured for releasably attaching engagement with the compact disk at the center hole.

In another aspect, the present invention provides, in combination, a ring binder and a holder for securing a compact disk to the ring binder. The combination comprises a ring binder including a cover having two side panel members and a binder mechanism secured to the cover. The mechanism has a plurality of ring members for retaining loose leaf pages. A compact disk holder is secured to the ring binder, the holder including a base having a front side and a back side. An annular hub is on the front side of the base configured for engagement by the compact disk to releasably mount the compact disk on the hub.

In yet another aspect, a ring binder of the present invention retains both loose leaf pages and at least one compact disk. The ring binder comprises a cover including two side panels and a ring binder mechanism secured to the cover, the mechanism including a plurality of ring members for holding the loose leaf pages. A CD holder is secured to the cover for releasably holding the at least one compact disk, the holder having a mounting portion configured for releasably attaching engagement with the compact disk. The mounting portion is made of a plastic material for engagement with the compact disk. A fastener fixedly secures the holder to the cover, the fastener having at least one securing member penetrating the cover. The fastener is made of a metallic material.

In still a further aspect, a ring binder of the present invention retains both loose leaf pages and at least one compact disk. The ring binder comprises a cover including two side panels and a ring binder mechanism secured to the cover. The mechanism includes a plurality of ring members for holding the loose leaf pages. A CD-holding loose leaf page has openings sized and positioned corresponding with the ring members so that the CD-holding page is releasably retained by the ring binder mechanism. The CD-holding page is made of a cardboard material. A CD holder is secured to the CD-holding page for releasably holding the at least one compact disk, the holder having a mounting portion configured for releasably attaching engagement with the compact disk. The mounting portion is made of a plastic material. The holder is secured to the CD-holding page by an adhesive.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
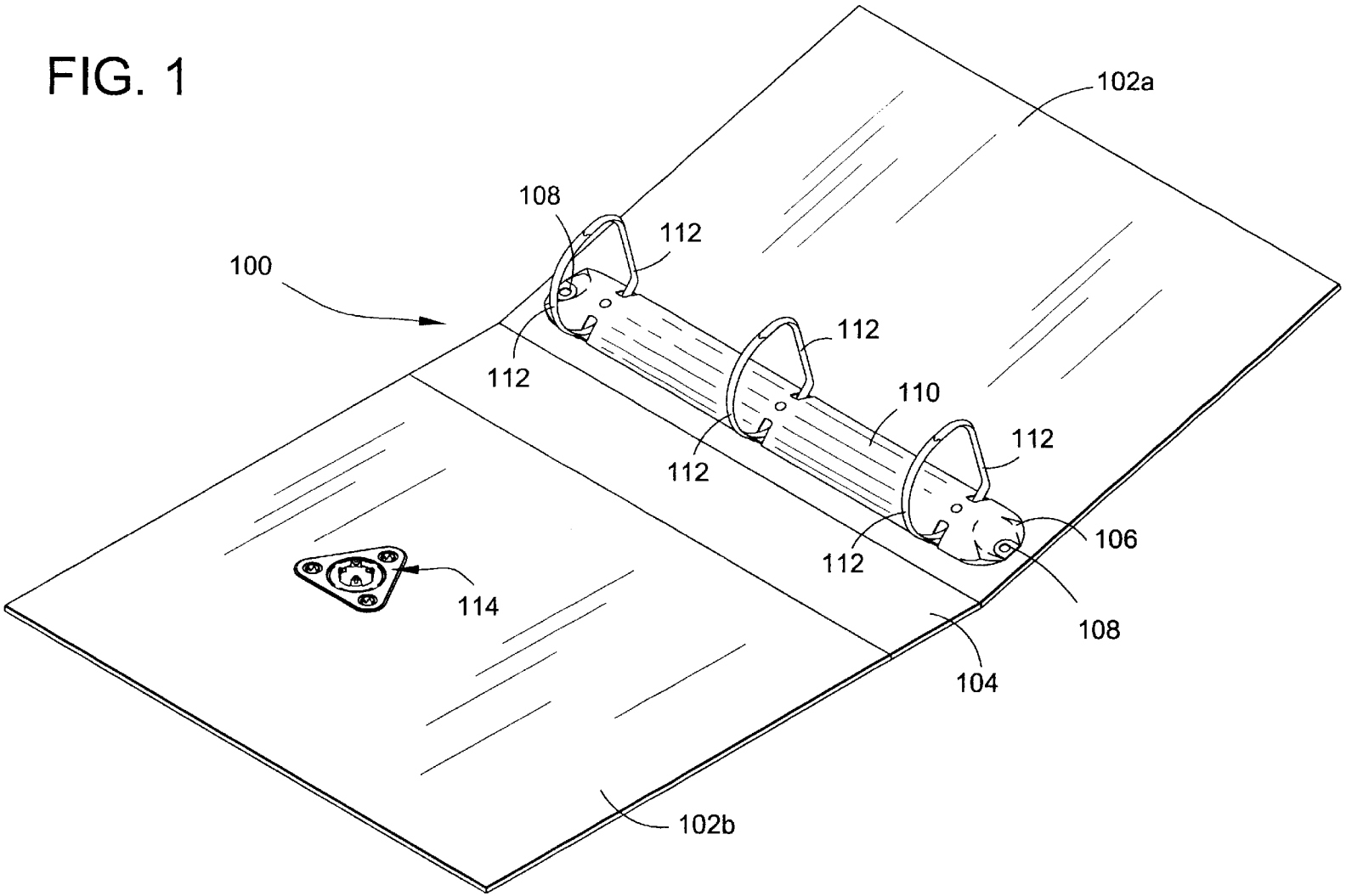
FIG. 1 is a perspective view of a first embodiment of a ring binder according to the present invention having a compact disk holder.
Figure 2:
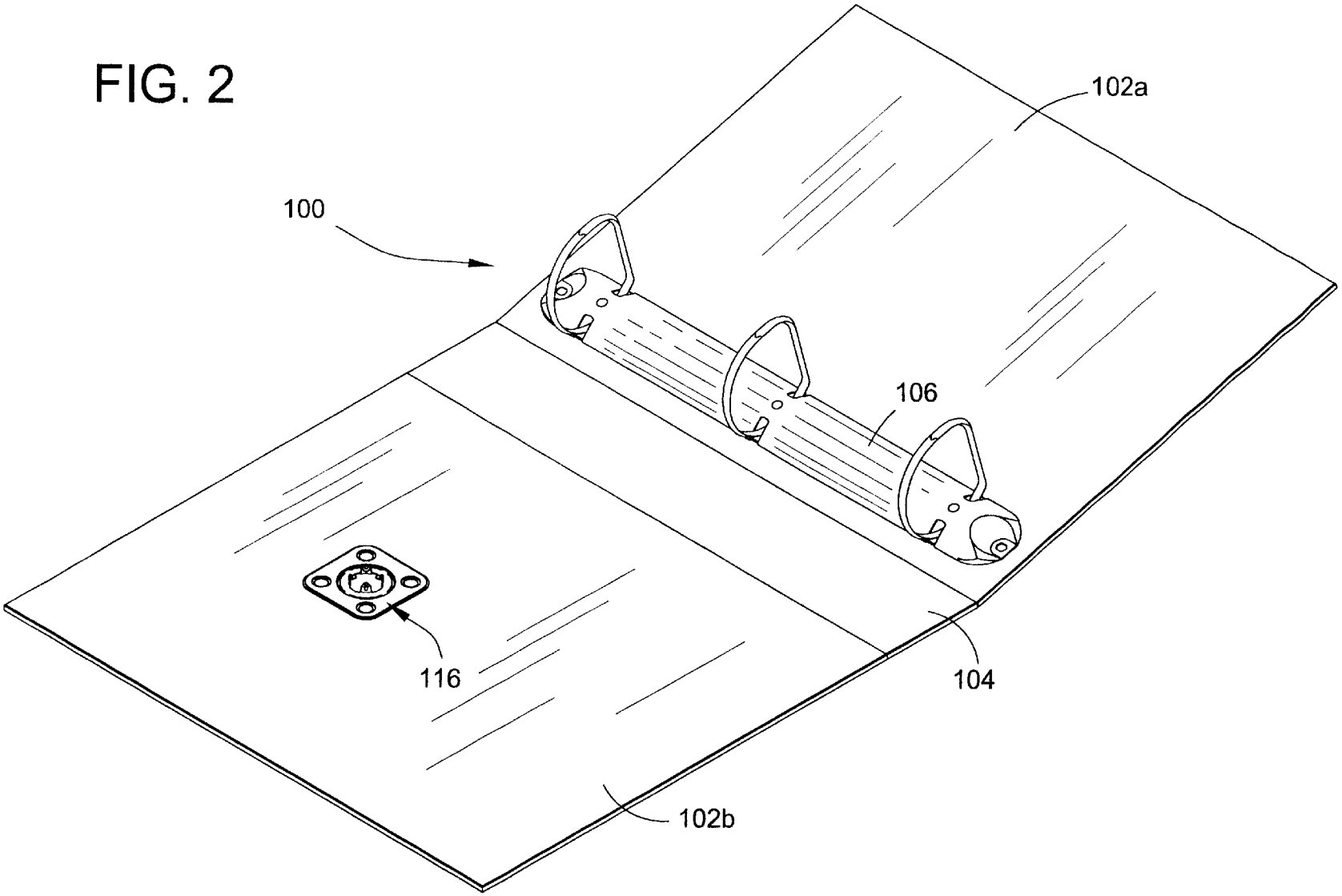
FIG. 2 is a perspective view of the ring binder of the first embodiment having a compact disk holder of an alternate, rectangular shape.
Figure 6A:
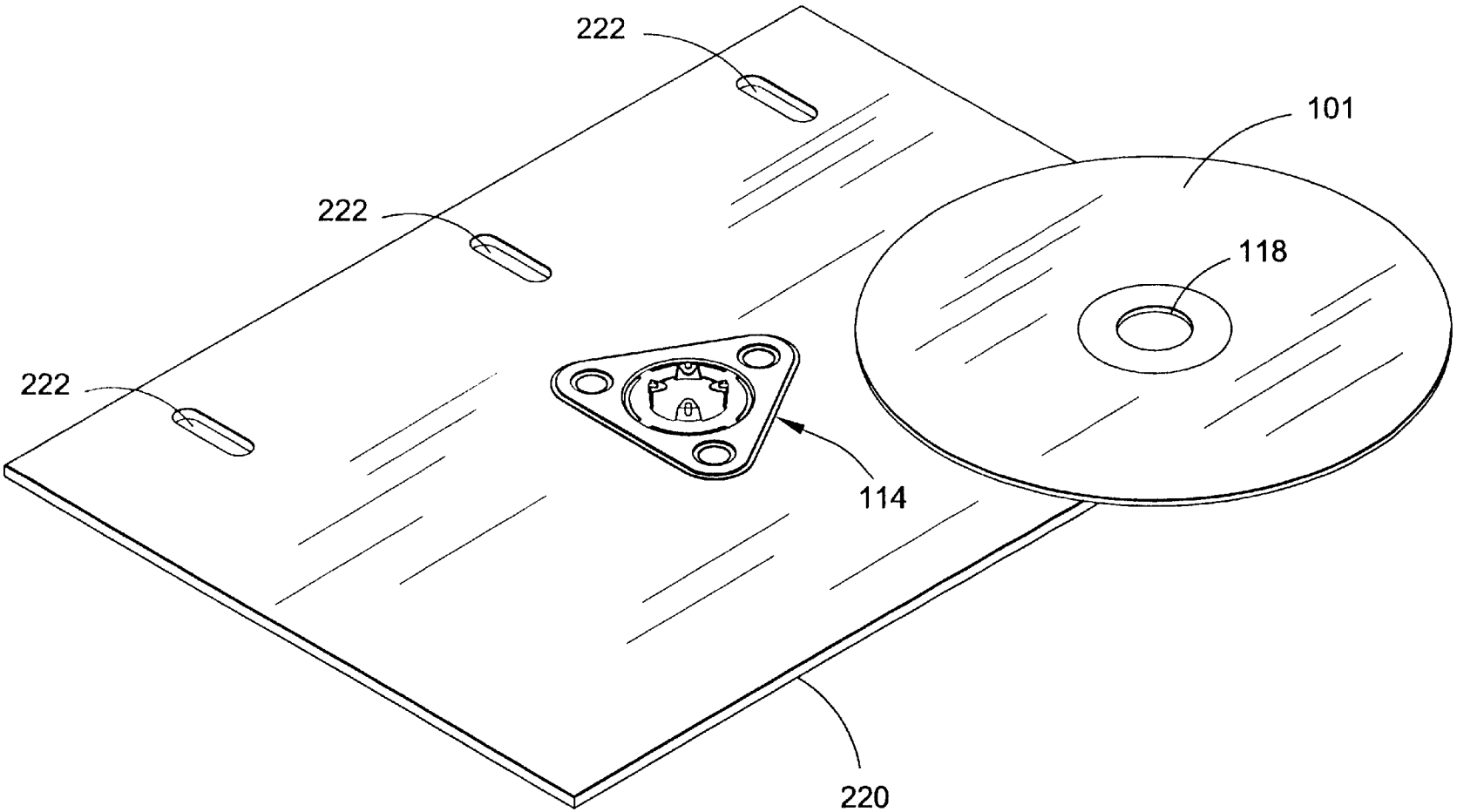
FIG. 6A is a perspective view of the compact disk holder of FIG. 1 secured to a loose leaf page, forming part of a second embodiment of a ring binder according to the present invention, along with a compact disk.

Referring now to the drawings and in particular to FIGS. 1 and 2, a ring binder-type notebook (hereinafter "ring binder") according to the present invention is indicated generally at 100. The ring binder 100 simultaneously holds loose leaf pages (not shown) and a compact disk 101 (FIG. 6A), also referred to as "CD". In this connection, the term "compact disk" may include any data storage device which is generally thin and has a central opening, including a CD-ROM, video compact disk, or digital video disk. The ring binder 100 includes a cover having two side panels 102*a*, 102*b* joined by a central spine 104. A ring binder mechanism 106 is secured in a suitable manner such as by two rivets 108 to the side panel 102*a* (FIG. 1) or alternatively to the central spine 104. The ring binder mechanism 106 includes a curved substantially rigid upper plate 110 supporting a pair of pivoting plates (not shown). Three pairs of opposed ring members 112 extend through the upper plate and are fixedly secured to each of the pivoting plates. Each pair of ring members 112 may be opened or closed upon pivoting of the pivoting plates in a conventional manner, so that loose leaf pages may be retained by or retrieved from the ring binder 100. The ring binder may have a different number or type of ring members 112 without departing from the scope of this invention.

A compact disk holder, indicated generally at 114, is secured to the side panel 102*b* for releasably retaining the CD in the ring binder 100 on its inside cover. By providing additional holders (not shown), multiple compact disks may be stored in the ring binder 100. The holder 114 has a generally triangular shape. However, it is understood that the holder may have a variety of alternate shapes, such as a rectangular holder indicated generally at 116 in FIG. 2. The holders 114,116 are configured for engagement by the CD 101 at a center hole 118 (FIG. 6A) to releasably hold the CD securely in the ring binder.

Figure 3B:
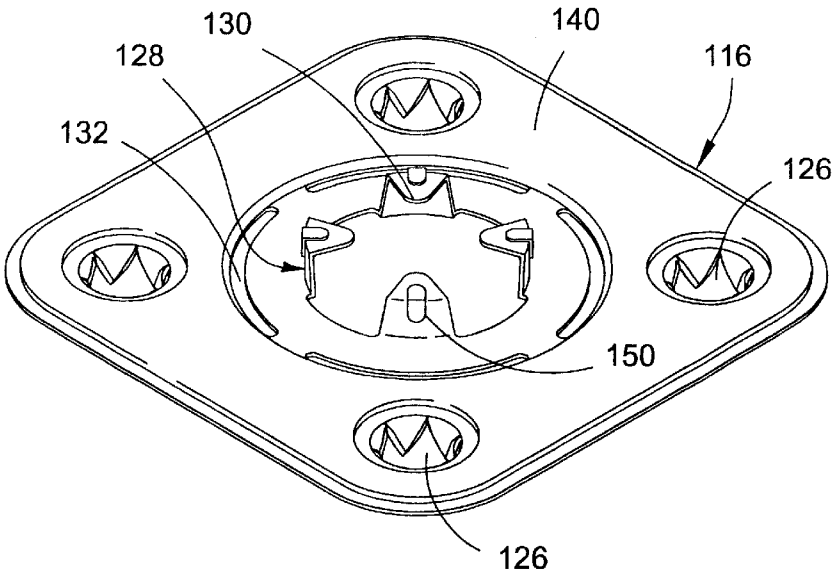
FIGS. 3A and 3B are perspective views of the front sides of the compact disk holders of FIGS. 1 and 2, respectively.
Figure 3A:
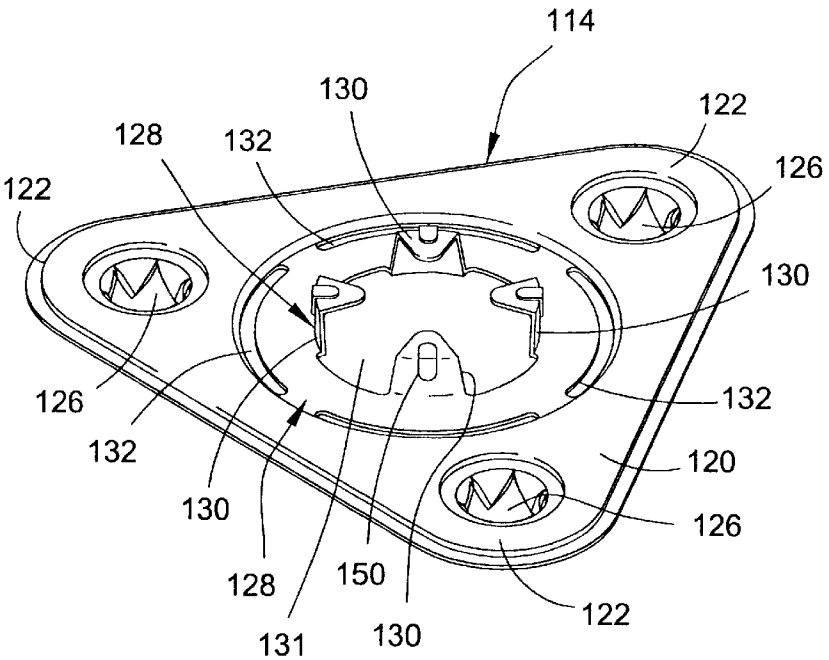
Figure 4B:
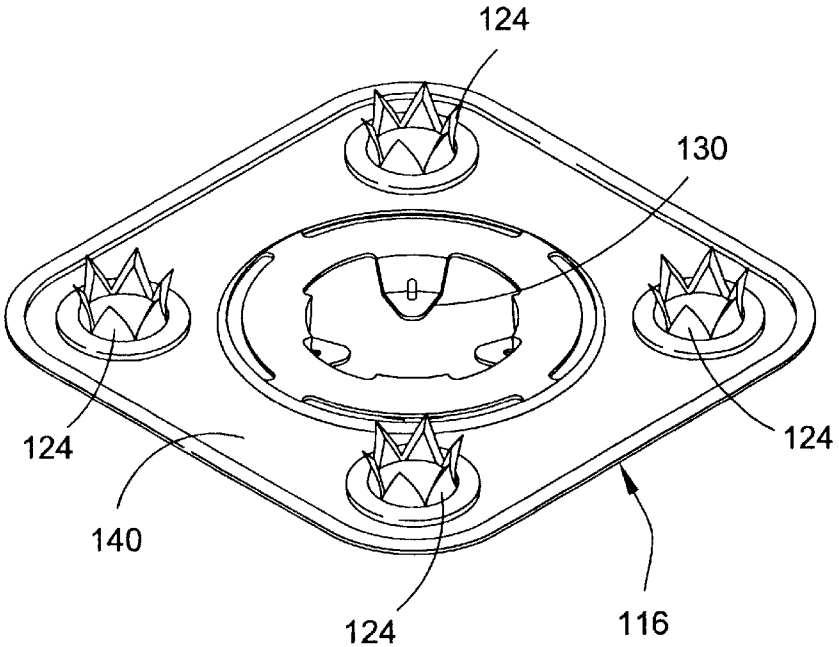
FIGS. 4A and 4B are perspective views of the back sides of the compact disk holders of FIGS. 1 and 2, respectively.
Figure 4A:
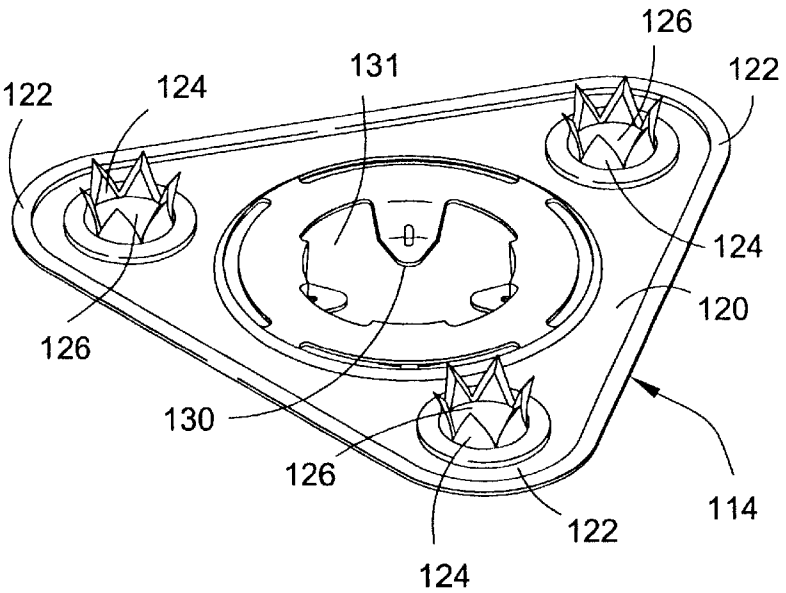

Referring to FIGS. 3A and 4A, the compact disk holder 114 includes a generally triangular plate 120 with rounded corners 122. Adjacent to each corner 122 are a plurality of claws 124 which extend downwardly from the undersurface of the plate 120. Each claw 124 extends generally away from a longitudinal axis of a respective circular aperture 126. Provided in a central area of the holder 114 is a mounting portion, generally indicated at 128, which retains the CD. The mounting portion 128 includes four resilient fingers 130 which extend generally upwardly from an upper surface of the plate 120 and uniformly around a central opening 131. The holder 114 also includes four arcuate slots 132 uniformly distributed around the central opening 131, each adjacent to or near a respective finger 130. The fingers 130 are nearer to the central opening 131 than are the slots 132. By way of such an arrangement, the fingers 130 are resiliently movable to retain the compact disk 101, or to allow the compact disk to be released, in a manner to be discussed below.

The holder 114 is made of one or more suitable materials for attaching the holder to the ring binder 100 and retaining a compact disk. Preferably, the claws 124 are made of a hard metal such as steel to penetrate and securely grip the cover, which is typically a pulp fiber material. The entire holder 114 may be made integrally of one piece steel. Alternatively, the claws 124 and plate 120 may be made of steel, with the mounting portion 128 being made of a generally non-abrasive material such as a plastic (e.g., injection molded polystyrene) which reduces likelihood of scratches or impact damage to the compact disk 101. The use of other materials in the holder does not depart from the scope of this invention.

As to the compact disk holder 116 shown in FIGS. 3B and 4B, its main difference with the holder 114 shown in FIGS. 3A and 4A is that its plate 140 is generally square in shape. There are four sets of claws 124, one at each corner of the plate 140. It is understood that the plate of the compact disk holder can have any shape, regular or irregular in nature, without departing from the scope of this invention.

Figure 5A:
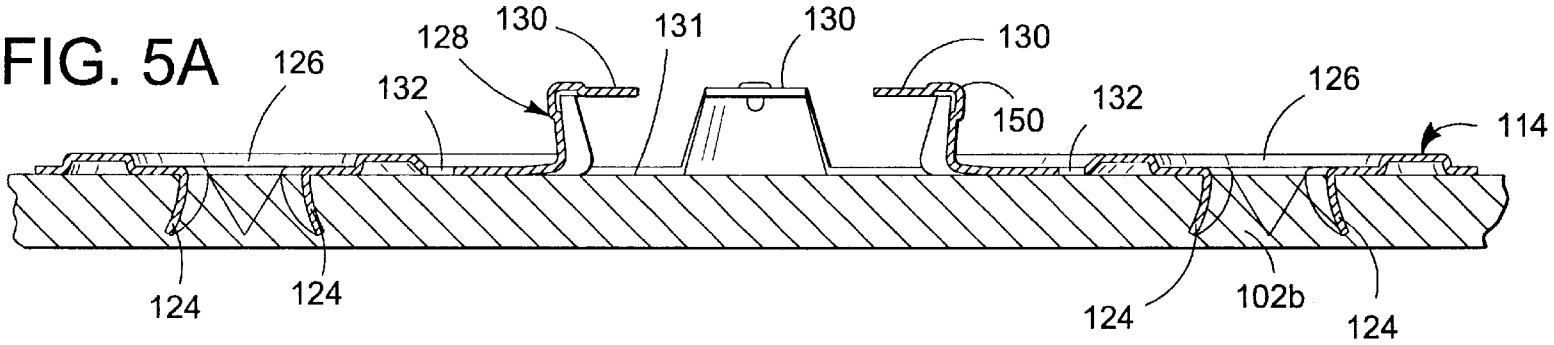
FIGS. 5A to 5C are sectional views of the ring binder showing the manner in which a compact disk is engaged with or disengaged from the compact disk holder.
Figure 5B:
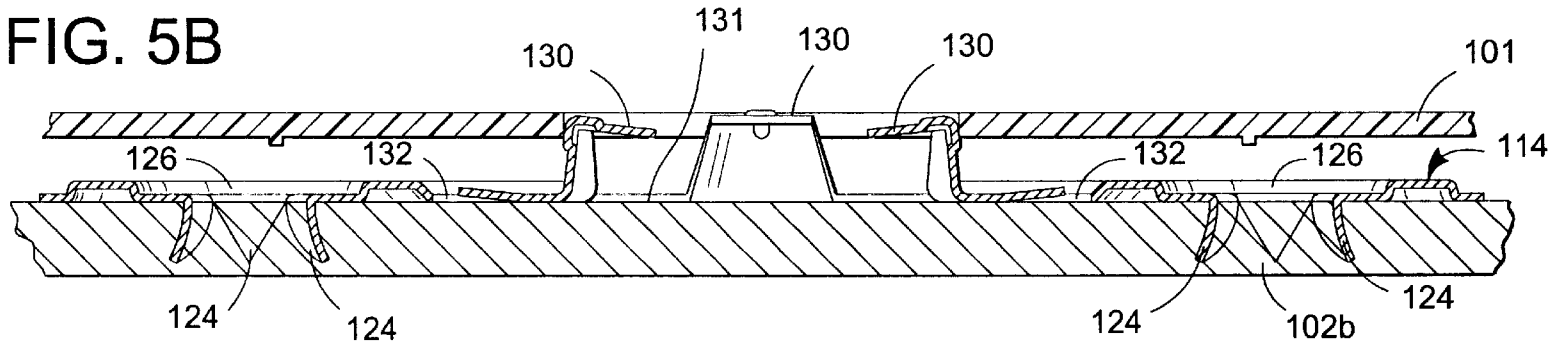
Figure 5C:
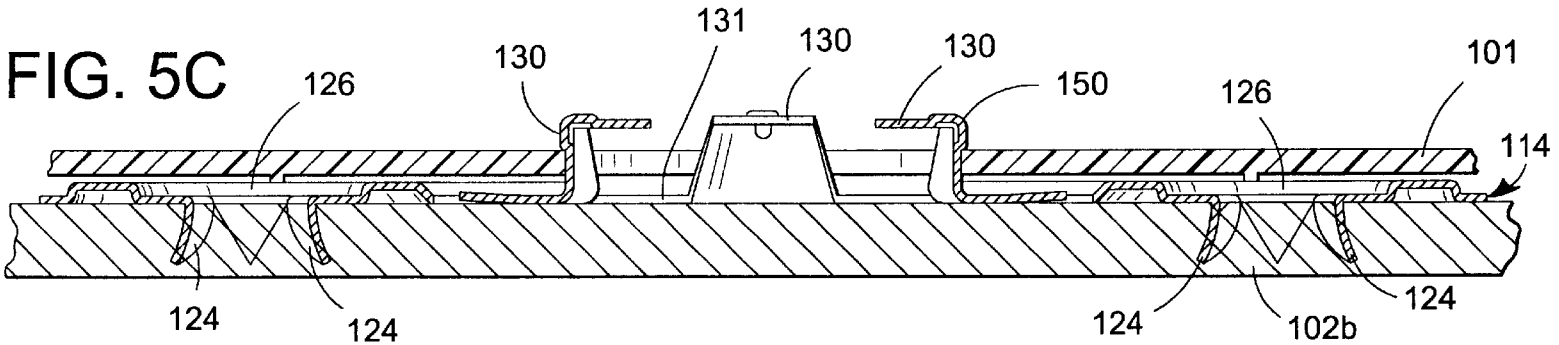

FIGS. 5A to 5C illustrate the manner in which the compact disk 101 may be engaged with or disengaged from the holder 114, although it should be understood that the same principle applies in respect of the compact disk holder 116. It can be seen in FIG. 5A that the claws 124 of the compact disk holder 114 penetrate into the side panel 102*b*, so that the holder is fixedly secured to the side panel. This engagement between the compact disk holder 114 and the side panel 102*b* is enhanced by the fact that the claws 124 flare away from the aperture 126, securely holding and preventing disengagement. The fingers 130 extend slightly away (FIG. 5A) from the longitudinal axis of the opening 131. When the compact disk 101 is pushed onto the compact disk holder 114 (as shown in FIG. 5B), the fingers 130 are caused to bend slightly inwardly (which is facilitated by the existence of the arcuate slots 132). Each finger 130 has a shoulder 150 for retaining the CD. When the fingers bend inwardly, the shoulders 150 also move inwardly so that the center hole 118 of the CD can be readily moved over the shoulders. Once past the shoulders 150, the fingers 130 move radially outwardly to position the shoulders above the CD 101 thereby retaining the CD on the holder 114 (FIG. 5C). The engagement between the compact disk 101 and the compact disk holder 114 is thus in a snap-fit manner.

If the compact disk 101 is to be disengaged from the holder 114, a user acts on the fingers 130 (as by pressing down on axially inwardly extending portions of the fingers) to bend them slightly inwardly to the position shown in FIG. 5B. The disk 101 may then be moved upwardly past the shoulders 150 and disengaged from the holder.

Figure 6B:
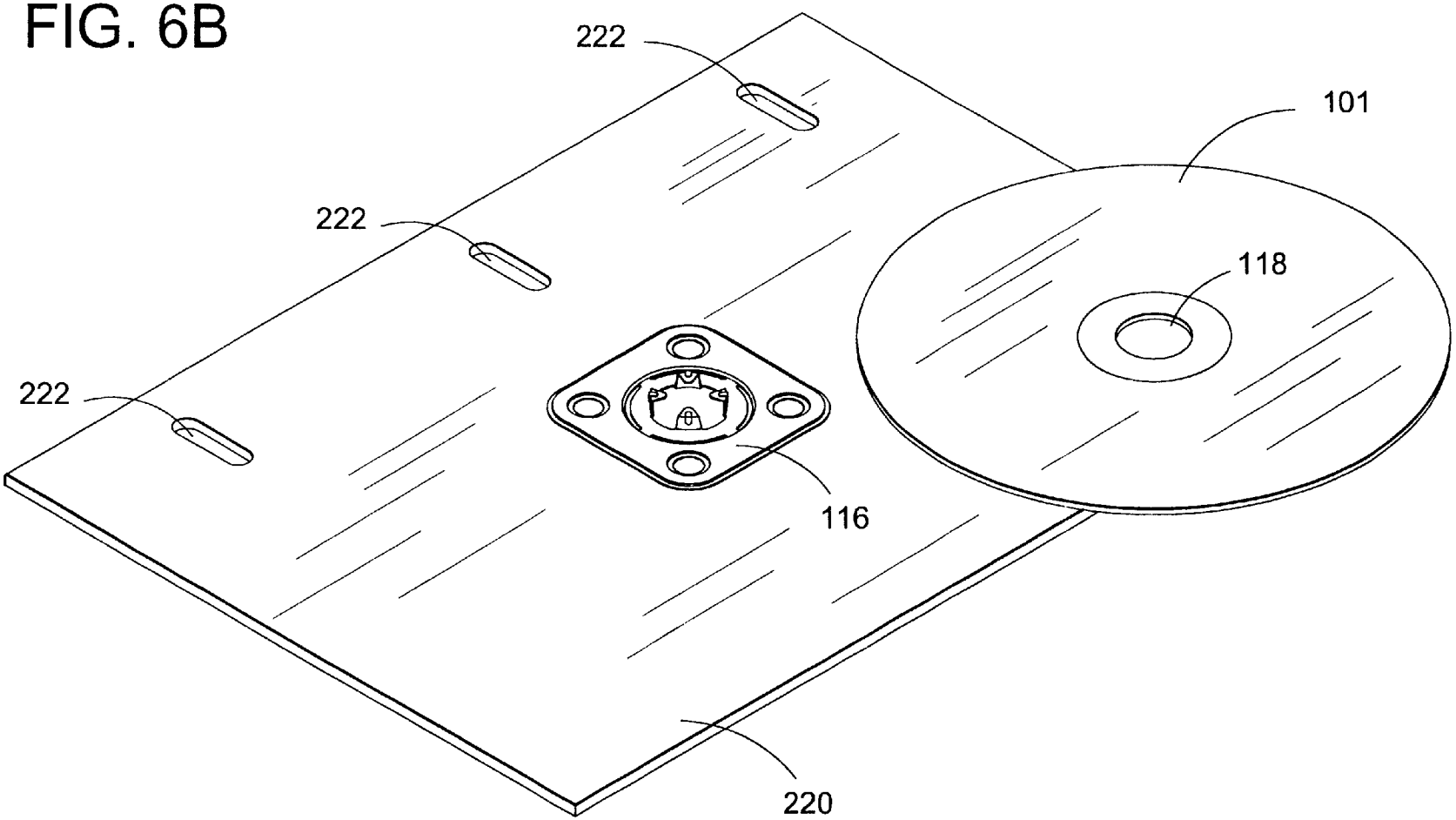
FIG. 6B is a view similar to FIG. 6A showing the second embodiment with the compact disk holder of an alternate, rectangular shape.

In a second embodiment of the invention, the compact disk holder 114 (FIG. 6A) or 116 (FIG. 6B), may be secured to a rectangular loose leaf page 220. The page 220 (also referred to as a CD-holding page) includes three openings 222. The openings 222 are positioned, sized and configured to allow the ring members 112 to extend through, so that the page may be retained by the ring binder mechanism 106 and movable relative to it. This allows the compact disk 101 to be stored among other loose leaf pages, according to the purpose of the user. Although three openings 222 are shown, it is understood that there may be two openings to match a differently arranged set of ring members 112, or any number of openings. The loose leaf page 220 may be made of any suitable, generally rigid material, such as a cardboard, which is capable of mounting at least one holder 114 and corresponding CD. There may be a second holder 114 or 116 (not shown) on the opposite or reverse side of the loose leaf page 220, or any number of loose leaf pages 220 and corresponding holders in the ring binder, without departing from the scope of this invention.

Figure 7:
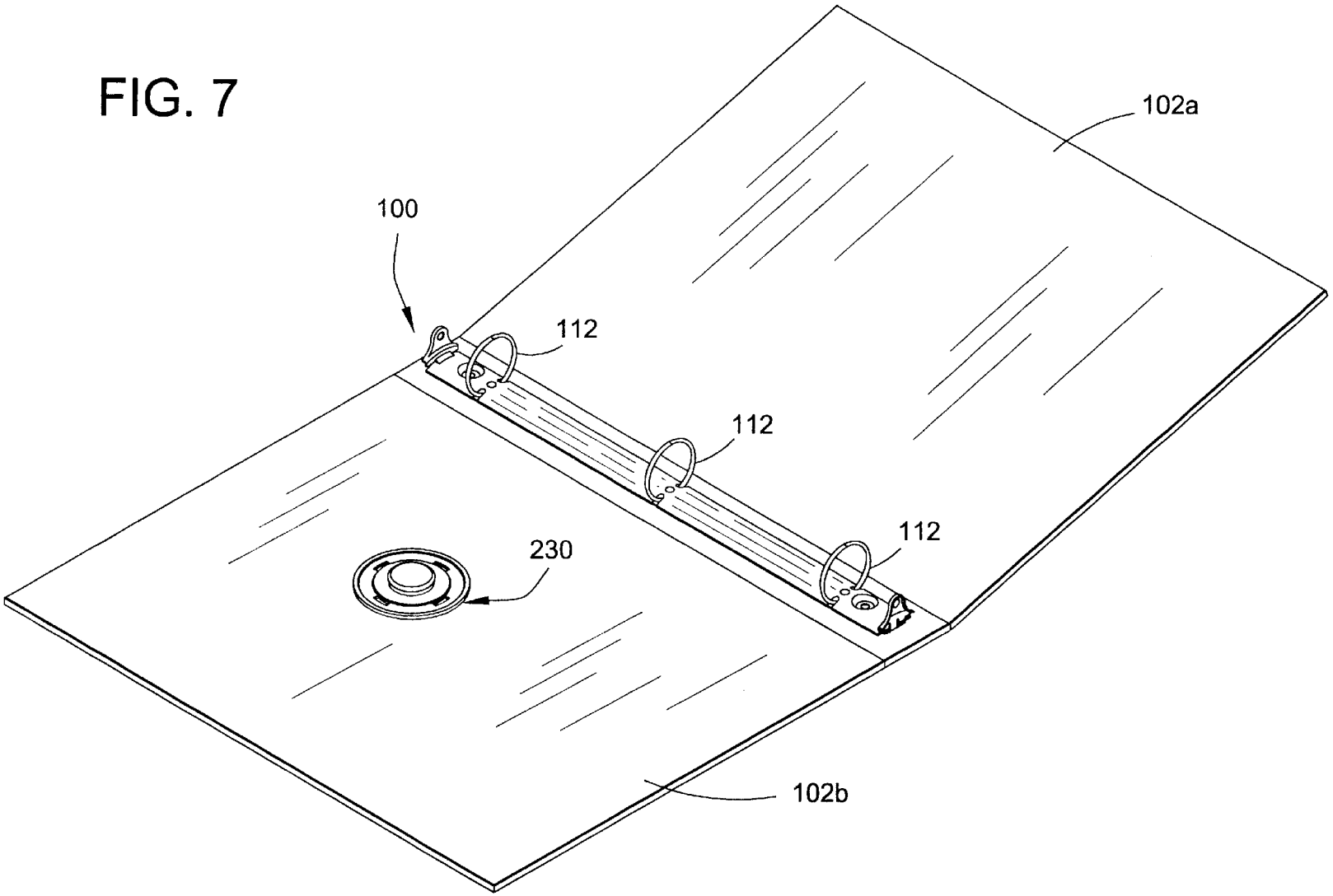
FIG. 7 is a perspective view of a third embodiment of the ring binder of the present invention having a circular-shaped compact disk holder with a central hub.
Figure 8:
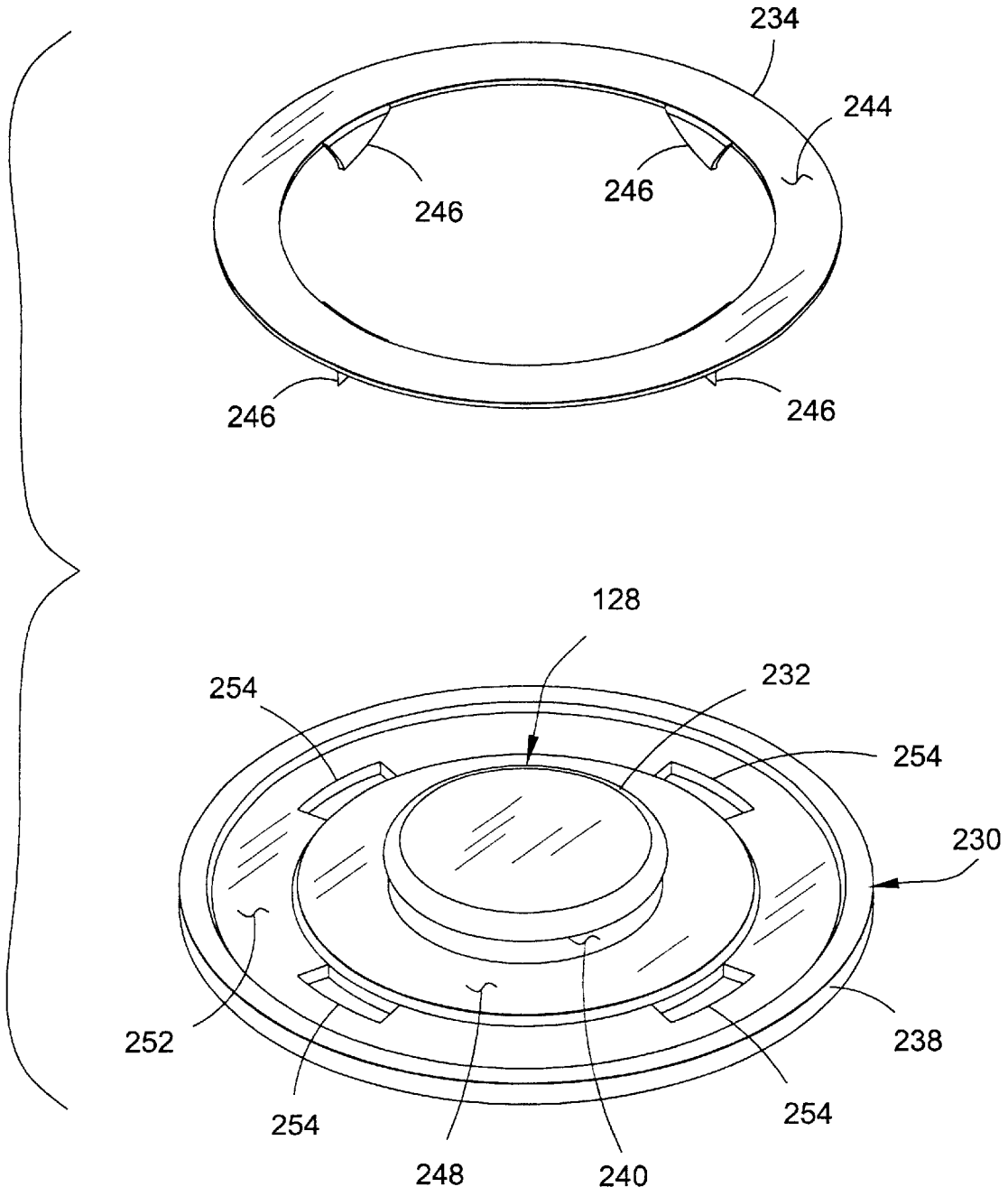
FIG. 8 is an enlarged front side perspective view of the compact disk holder of FIG. 7 along with a corresponding securing fastener.

Referring to FIGS. 7 and 8, a third embodiment of the ring binder includes a generally circular-shaped compact disk holder, indicated generally at 230, having the mounting portion 128 with a central hub 232 for engagement by the CD 101. The hub 232 is sized and shaped corresponding to the center hole 118 of the CD to releasably retain the CD generally as in the manner illustrated in FIGS. 5A–5C. The holder 230 may be secured to the side panel 102*b* by either a fastener 234 (FIGS. 8–11) or by an adhesive 236 (FIGS. 12–13), as described hereinafter.

As shown in FIG. 8, the holder 230 has a generally thin base 238 surrounding the central hub 232. The hub 232 is generally cylindrical in shape and includes an engagement surface 240 extending about a circumference of the hub for engaging the compact disk at its center hole 118. The engagement surface 240 of the hub extends continuously without interruption about the entire circumference. The CD may be mounted in a snap-fit manner into a retained position shown in FIG. 13. A shoulder 242 (FIG. 11) of enlarged diameter extends along an extremity of the hub 232 for further retaining the compact disk and inhibiting its unintentional release. Accordingly, the CD will not come dislodged even though the ring binder may be exposed to a strong impact or vibration. If the CD 101 is to be released from the holder 230, a user presses on the holder to flexibly bend it slightly inwardly. The disk 101 may then be moved upwardly past the shoulder 242 and disengaged from the holder.

Figure 9:
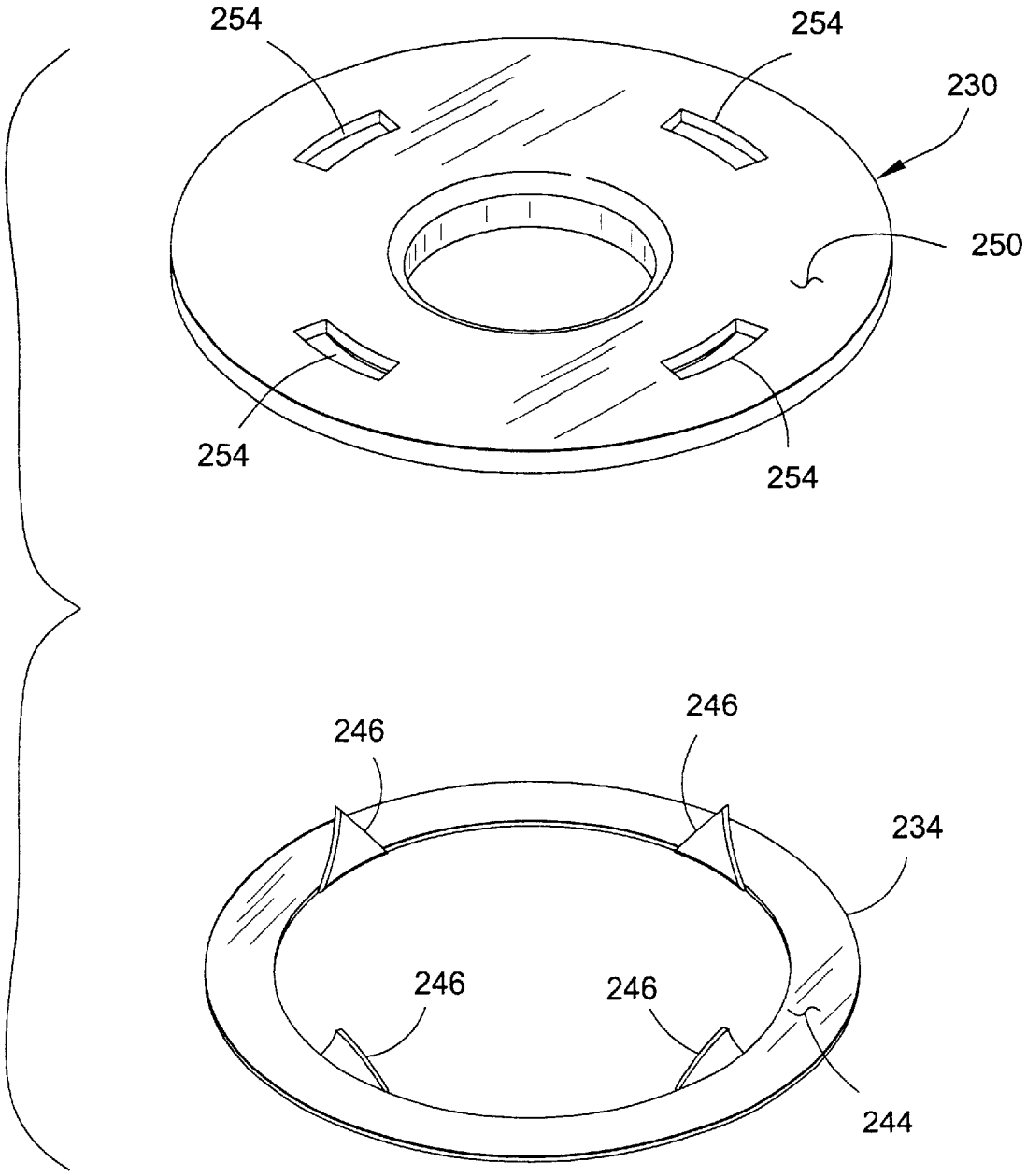
FIG. 9 is a perspective view of a back side of the holder and fastener of FIG. 8.
Figure 10B:
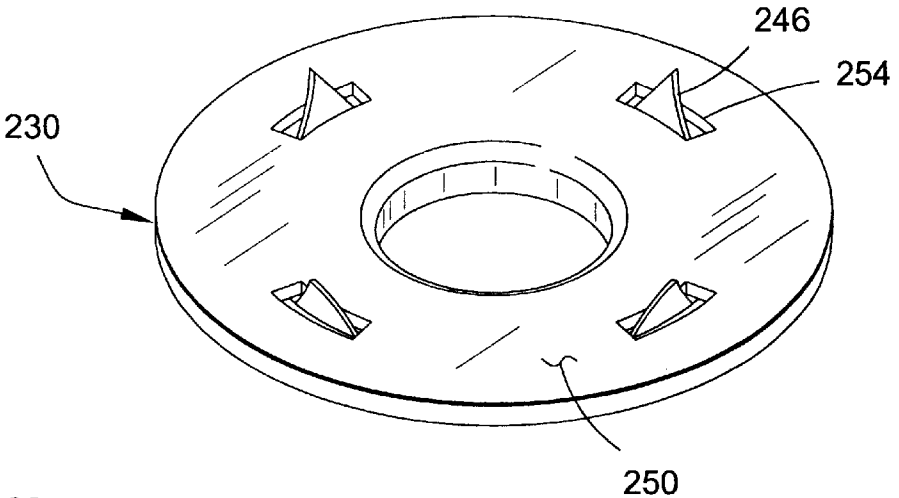
FIGS. 10A and 10B are respective front and back side perspective views of the holder and fastener of FIG. 8 in an engaged position.
Figure 10A:
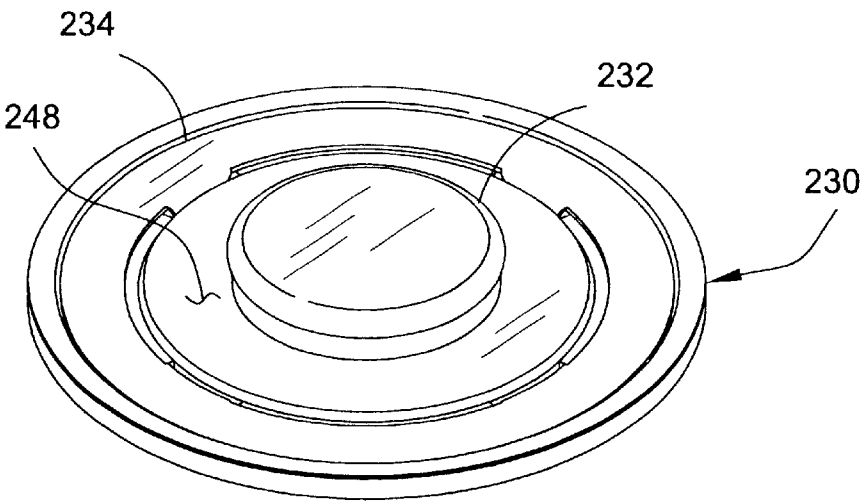

As shown in FIGS. 8 and 9, the fastener 234 has a generally flat, annular base 244 and four securing members, or prongs 246, depending from the base. The prongs 246 are disposed in circumferentially spaced relation and have pointed tips for penetrating the cover of the ring binder 100. Preferably, the prongs 246 are integral with the base 244. However, a fastener with non-integral securing members does not depart from the scope of this invention. Further, the fastener may have a different shape, including a non-annular shape, and may have a different number of securing members (including one).

The base 238 of holder 230 has a front surface 248, a back surface 250, and an annular recess 252 in the front surface sized and shaped for receiving the base 244 of the fastener 234. The back surface 250 is generally flat to lie flush against a surface of the cover or loose leaf page to which the holder 230 is to be secured. One or more openings 254 extend through the base from the front surface 248 to the back surface 250 and are positioned for receiving the prongs 246 of the fastener. The number of openings 254 corresponds to the number of prongs 246. Each opening 254 is located in the annular recess 252 and is sized and shaped to permit passage of a prong 246 through the holder 230. Preferably, each opening 254 is in the shape of an arcuate slot. The fastener 234 may be moved to an engaged position (FIGS. 10A and 10B) in which the base 244 rests in the recess 252 and the prongs 246 extend through the openings 254 and protrude from the back surface 250 for penetrating the cover or loose leaf page. A holder without openings, such as a holder penetrated by a fastener, does not depart from the scope of this invention.

The mounting portion of holder 230 is preferably made of a first material which is generally non-abrasive to the compact disk 101, such as plastic. The fastener 234 is made of a second material, harder than the mounting portion of the holder and suitable for penetrating the side panel 102*b* to secure the holder, such as metal. Exemplary first and second materials are injection molded polystyrene and steel, respectively. Other materials, or a single material for both holder and fastener, do not depart from the scope of this invention.

Figure 11:
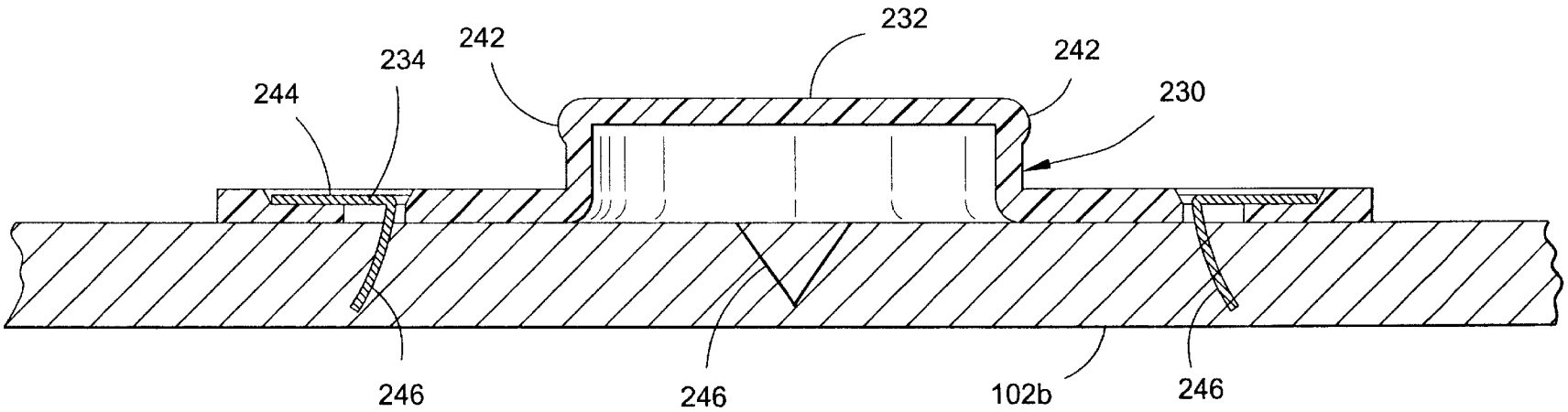
FIG. 11 is a fragmentary section of the ring binder of FIG. 7 with the holder secured by the fastener.
Figure 12:
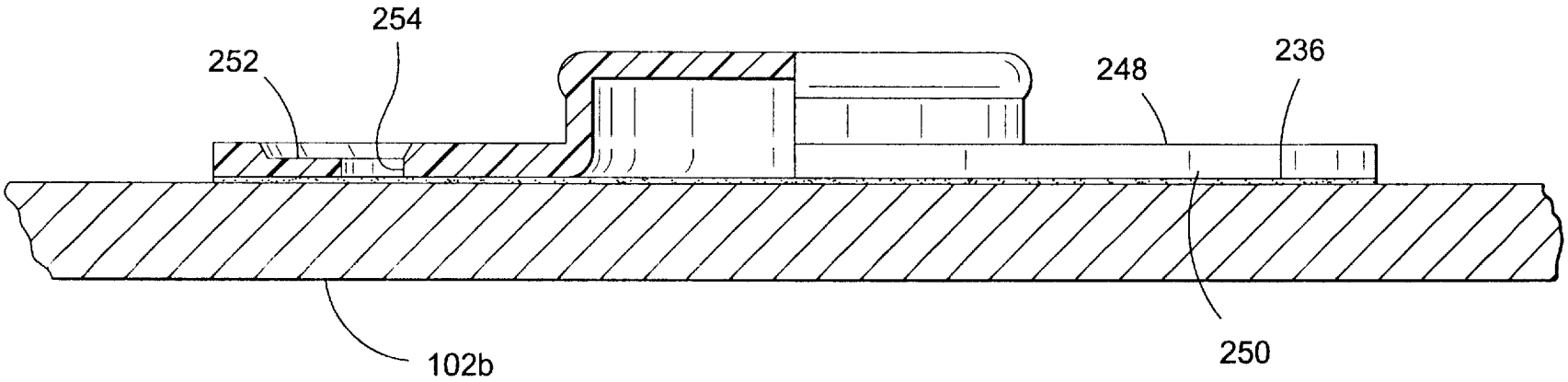
FIG. 12 is a fragmentary, partial section of the ring binder of FIG. 7 with the holder secured by an adhesive.
Figure 13:
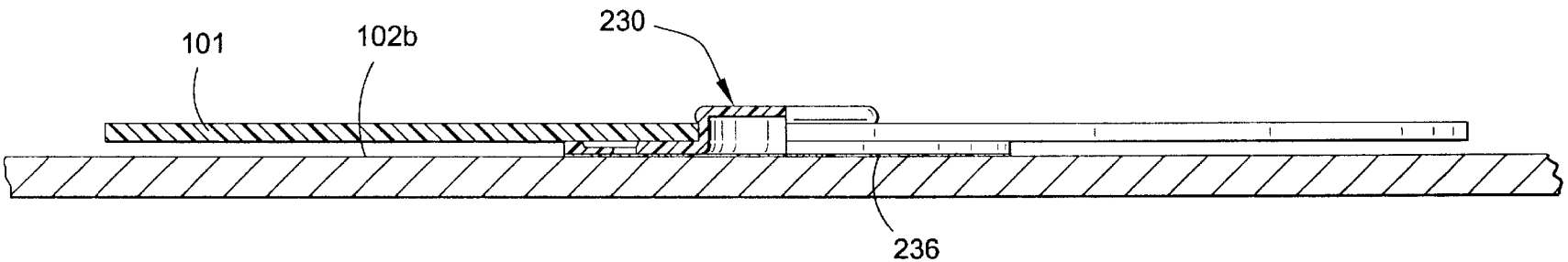
FIG. 13 is a fragmentary, partial section of the ring binder of FIG. 7 with a compact disk mounted on the holder.

As shown in FIG. 11, the holder 230 is affixed to the side panel 102*b* by the prongs 246 of the fastener which penetrate and securely grip the side panel. The fastener 234 and holder 230 are installed by aligning the prongs 246 with the openings 254 and pressing the fastener into the side panel, with the holder in sandwiched position, such that the prongs pass through the openings and penetrate the side panel. Installation may be done manually, such as by tapping with a hammer, but is typically done using an automatic impact machine. Alternatively, the holder 230 may be secured to the side panel 102*b* by the adhesive 236 applied along the back surface 250 (FIGS. 12 and 13). When adhesive is used, the fastener 234 is unneeded and the recess 252 in the front surface of the holder and openings 254 are not required. However, the holder may retain these features for flexibility of use and common manufacturing with holders which are attached by fasteners.

Figure 14:
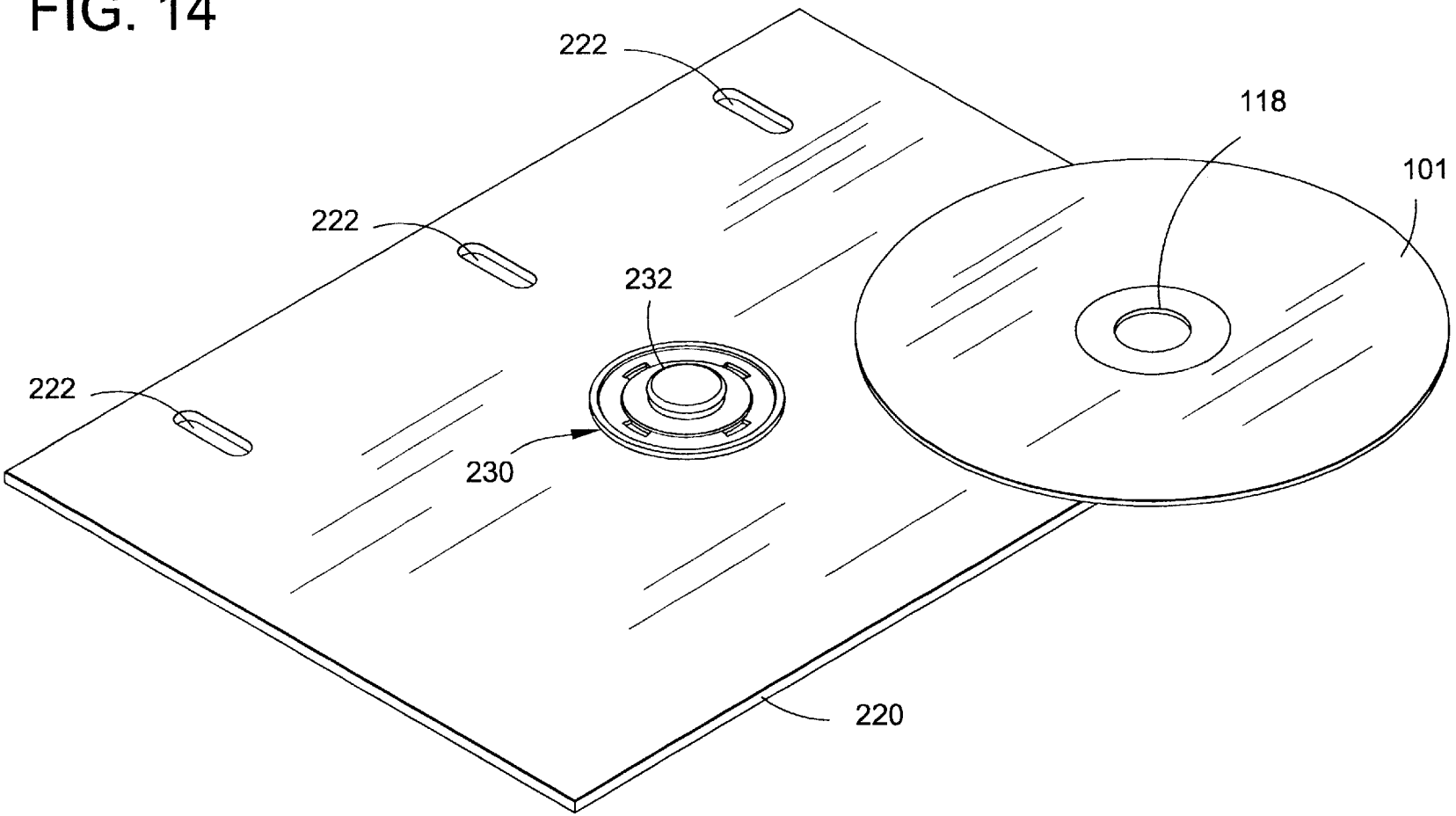
FIG. 14 is a perspective view of the compact disk holder of FIG. 7 secured to a loose leaf page, forming part of a fourth embodiment of the present invention, along with a compact disk.

Referring to FIG. 14, a fourth embodiment of the present invention includes a compact disk holder 230 with a central hub 232 (as in the third embodiment) and secured to a loose leaf page 220. The page 220 includes three openings 222 which are positioned, sized and configured to allow the ring members 112 to extend through so that the page may be retained by the ring binder mechanism 106 and movable relative to it. This allows the compact disk 101 to be stored among other loose leaf pages, according to the purpose of the user. Although three openings 222 are shown, it is understood that there may be any number of openings. The loose leaf page 220 may be made of any suitable, generally rigid material, such as a cardboard, which is capable of mounting at least one holder 230 and corresponding CD 101. The holder may be secured to the loose leaf page by either the fastener 234 or the adhesive 236.

Figure 15:
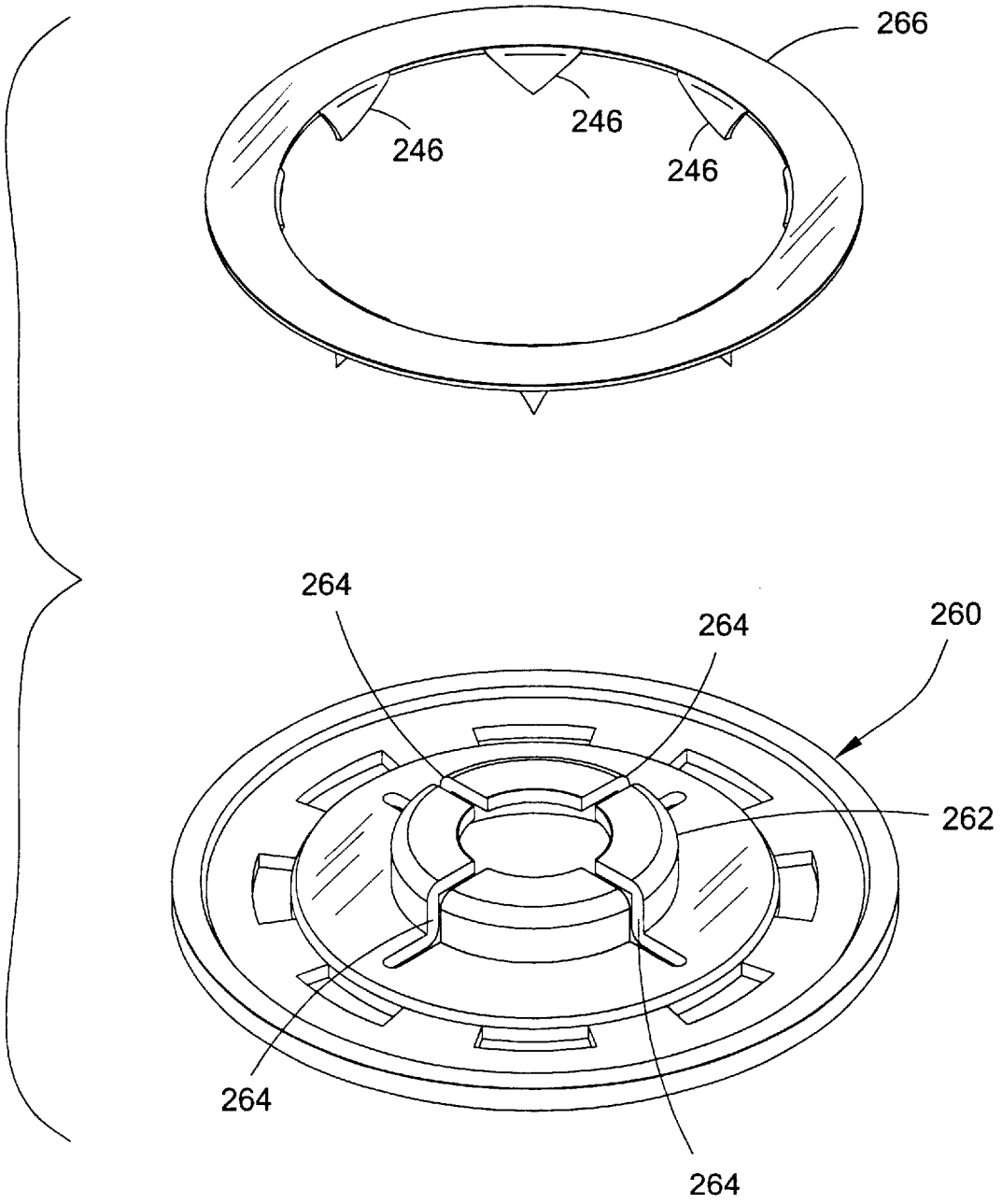
FIG. 15 is a front side perspective view of a compact disk holder having slots in the central hub, forming part of a fifth embodiment of the present invention, along with a corresponding securing fastener.
Figure 16:
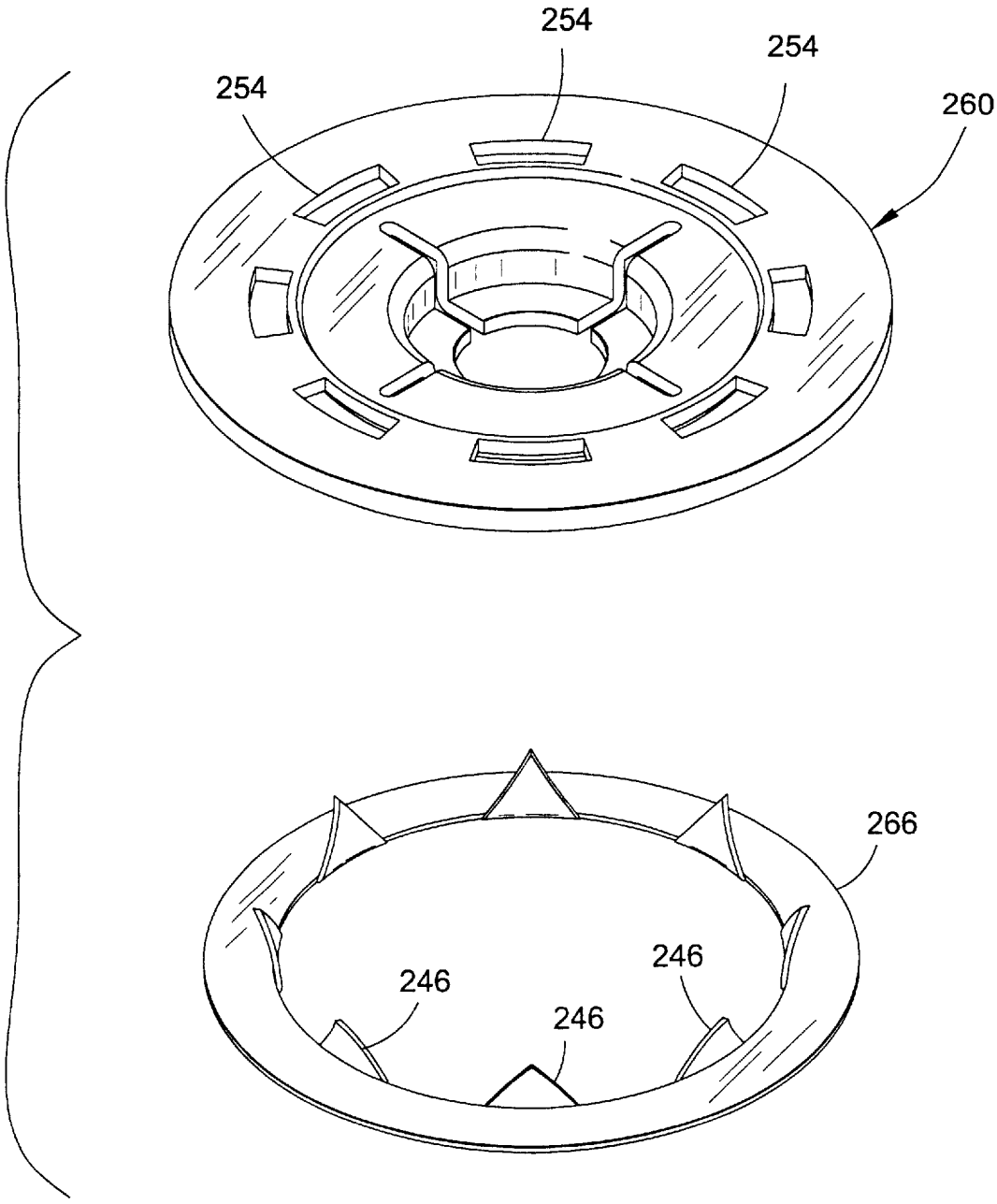
FIG. 16 is a perspective view of back sides of the holder and fastener of FIG. 15.
Figure 17B:
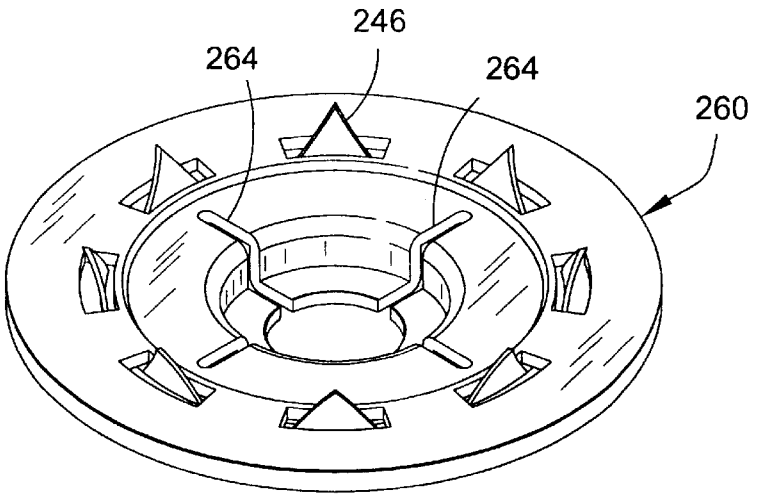
FIGS. 17A and 17B are respective front and back side perspective views of the holder and fastener of FIG. 15 in an engaged position.
Figure 17A:
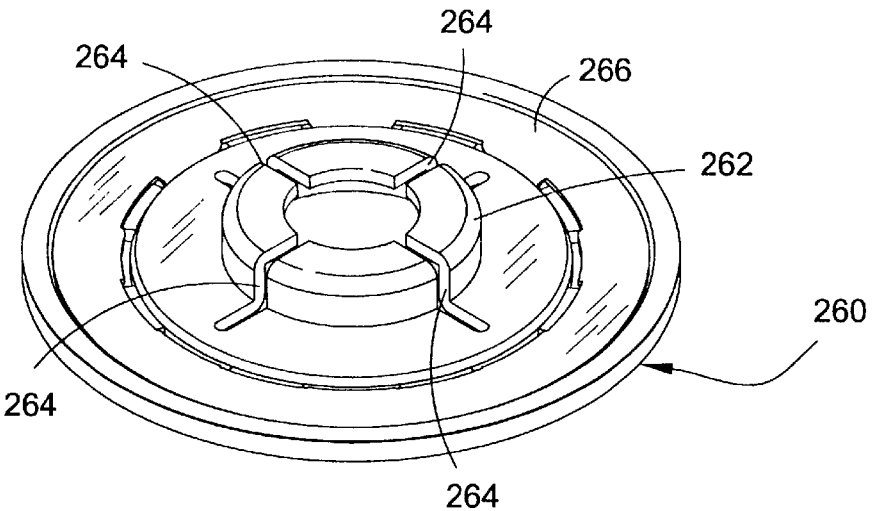
Figure 18:
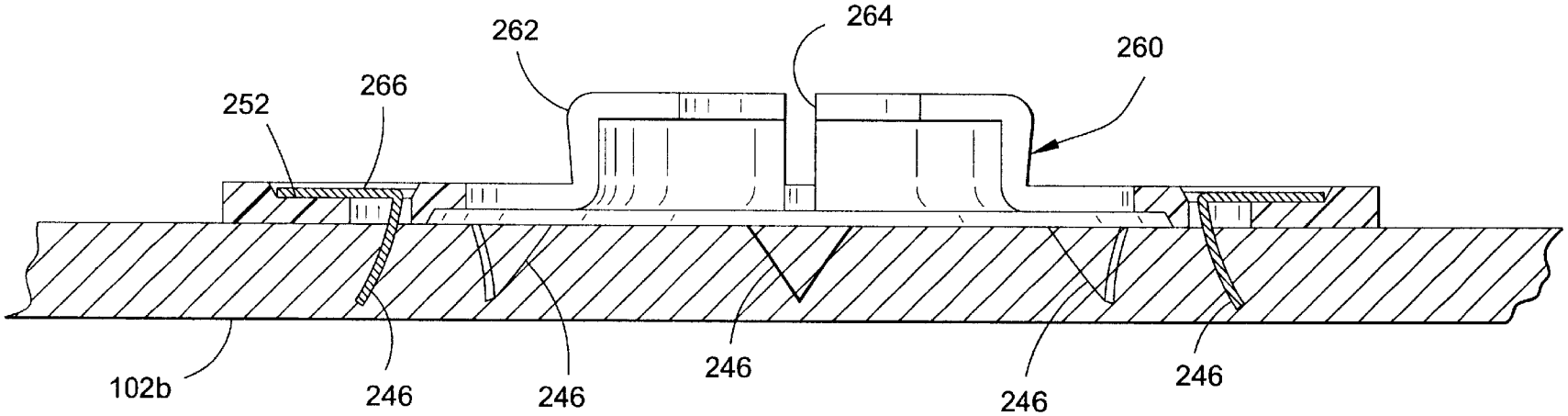
FIG. 18 is a fragmentary section of the ring binder with the holder of FIG. 15 secured by the fastener of FIG. 15.

A fifth embodiment of the present invention includes elements shown in FIGS. 15 through 19. The fifth embodiment has a holder, generally indicated at 260, with a central hub 262 having an engagement surface which is discontinuous. Four slots 264 extend through the hub 262 for providing flexibility in the hub when engaged by the compact disk 101. That permits an easier snapfit engagement of the center hole 118 of the CD onto the hub, and allows for minor dimensional variations in the size of either the center hole 118 or the hub 262. For instance, a CD may have a center hole which is out of round or with a diameter slightly smaller than a standard size, due to manufacturing tolerances. The slots 264 provide for an easier mounting and removal of the compact disk by the user's applying pressure to a portion of the hub 262 so that it deflects. A portion of the hub between two slots may be bent slightly inward to decrease the local diameter of the hub. Although four slots 264 are shown in FIG. 15, there can be a single slot or any number of slots in the hub.

Figure 19:
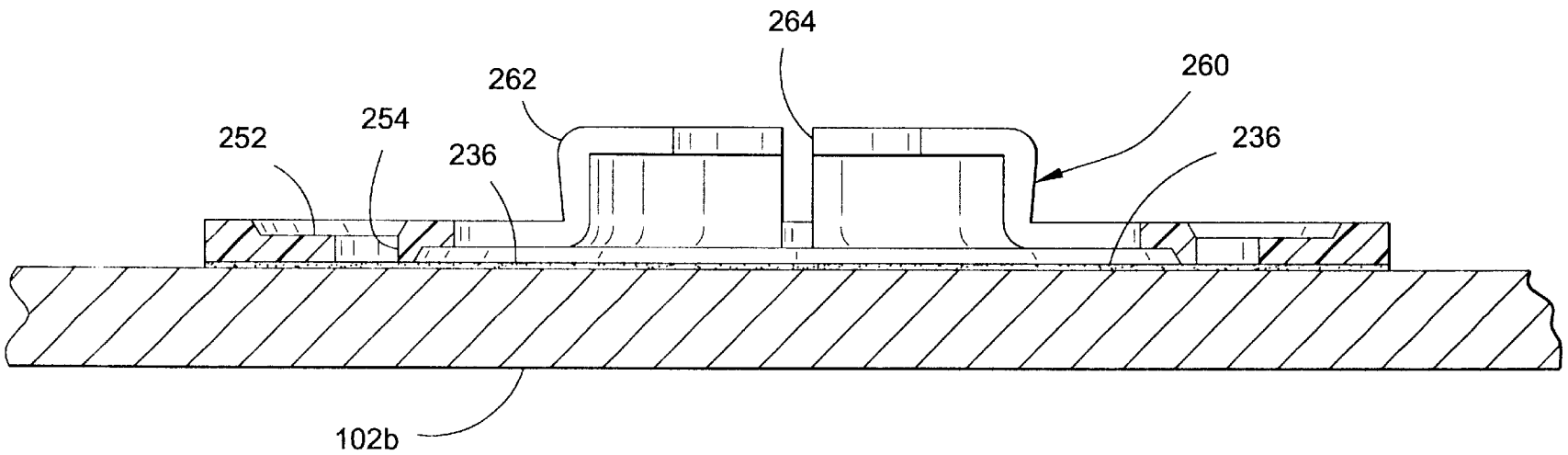
FIG. 19 is a view similar to FIG. 18 but with the holder secured by an adhesive.

A fastener 266 of the fifth embodiment has eight prongs 246 (FIG. 16), disposed in circumferentially spaced relation about the fastener, for penetrating either the cover or a loose leaf page. The holder 260 has a corresponding number of openings 254. The fastener 266 may have a different number of prongs or other securing members (including one) without departing from the scope of this invention. The fastener 266 may be moved to an engaged position (FIGS. 17A, 17B, and 18) in which it engages the recess 252 of the holder and the prongs 246 extend through openings 254 and protrude from the back surface. Alternatively, the holder of the fifth embodiment may be secured to the cover of the ring binder by the adhesive 236 (FIG. 19).

The ring binder 100 of the present invention may be readily prepared from existing ring binders which do not have a CD holder. A holder (114,116, 230, or 260) may be installed on the front side panel 102*a* or back side panel 102*b* of the cover. If the cover is of a size sufficiently large relative to the CD 101, there may be two holders installed on each cover to mount two adjacent CDs. To install a holder, the fastener is pressed against the cover such that the securing members pass through the openings and penetrate into the cover to a fixed position. Alternatively, a layer of adhesive 236 may be applied to the back side of the holder and placed against the cover. Further, if the holder is secured to a loose leaf page 220 (as in the second and fourth embodiments), the loose leaf page may be retained in the ring binder with the ring members 112 extending through the openings 222. Multiple loose leaf pages 220 may be included.

Although the present invention is primarily intended to hold compact disks having a center hole, the invention could be used to mount other information storage devices with a hole not on center.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A notebook for simultaneously holding loose leaf pages and at least one compact disk, the compact disk having a center hole therethrough, the notebook comprising:

a cover including two side panels;

a ring binder mechanism secured to the cover, the mechanism including a plurality of ring members for holding said loose leaf pages;

a compact disk holder secured to the cover for releasably holding said at least one compact disk, the holder having a mounting portion configured for releasably attaching engagement with the compact disk at said center hole, said mounting portion being made of a non-abrasive material whereby damage to the compact disk is inhibited; and a fastener fixedly securing said mounting portion to said cover, the fastener having at least one securing member penetrating the cover.

2. A notebook as set forth in claim 1 wherein the fastener is made of a harder material than the mounting portion.

3. A notebook as set forth in claim 2 wherein the fastener is made of metal.

4. A notebook as set forth in claim 1 wherein said holder has at least one opening extending through the holder for receiving said securing member of the fastener therethrough.

5. A notebook as set forth in claim 4 wherein said fastener has a generally flat, annular base and a plurality of securing members depending therefrom, the securing members disposed in spaced relation about the base.

6. A notebook as set forth in claim 5 wherein said securing members are integral with said base.

7. A notebook as set forth in claim 5 wherein said holder has a recess shaped and sized for receiving said base.

8. A notebook as set forth in claim 7 wherein said openings are located in said recess.

9. In combination, a ring binder and a holder for securing a compact disk to the ring binder, the combination comprising:

a ring binder including a cover having two side panel members and a binder mechanism secured to the cover, the mechanism having a plurality of ring members for retaining loose leaf pages;

a compact disk holder secured to said ring binder, the holder including a base having a front side and a back side, and an annular hub on the front side of the base configured for engagement by said compact disk to releasably mount the compact disk on the hub; and a loose leaf page member having at least one opening therethrough corresponding to at least one of said ring members for retaining the page to said mechanism, said compact disk holder being fixedly attached to said page member.

10. A ring binder for retaining both loose leaf pages and at least one compact disk, the ring binder comprising:

a cover including two side panels;

a ring binder mechanism secured to the cover, the mechanism including a plurality of ring members for holding said loose leaf pages;

a CD holder secured to the cover for releasably holding said at least one compact disk, the holder having a mounting portion configured for releasably attaching engagement with the compact disk, said mounting portion being made of a plastic material for engagement with the compact disk; and a fastener fixedly securing said holder to said cover, the fastener having at least one securing member penetrating the cover, the fastener being made of a metallic material.

11. A ring binder for retaining both loose leaf pages and at least one compact disk, the ring binder comprising:

a cover including two side panels;

a ring binder mechanism secured to the cover, the mechanism including a plurality of ring members for holding said loose leaf pages;

a CD-holding loose leaf page having openings sized and positioned corresponding with said ring members so that the CD-holding page is releasably retained by the ring binder mechanism, the CD-holding page being made of a Cardboard material; and a CD holder secured to said CD-holding page for releasably holding said at least one compact disk, the holder having a mounting portion configured for releasably attaching engagement with the compact disk, said mounting portion being made of a plastic material, the holder being secured to the CD-holding page by an adhesive.

* * * * *

UNITED STATES PATENT AND TRADEMARK OFFICE

CERTIFICATE OF CORRECTION

PATENT NO. : 6,382,863 B1
DATED : May 7, 2002
INVENTOR(S) : Chun On To et al.

It is certified that error appears in the above-identified patent and that said Letters Patent is hereby corrected as shown below:

Title page,
Item [73], reads "Laco Stationery Manufacturing Company, Limited" whereas it should read -- Leco Stationery Manufacturing Company, Limited --.

Signed and Sealed this

Ninth Day of July, 2002

*Attest:*

*Attesting Officer*

JAMES E. ROGAN
*Director of the United States Patent and Trademark Office*